US005789971A

United States Patent [19]

Colletti et al.

[11] Patent Number: 5,789,971

[45] Date of Patent: Aug. 4, 1998

[54] PROTECTION CIRCUIT AND METHOD FOR POWER TRANSISTORS, VOLTAGE REGULATOR USING THE SAME

[75] Inventors: Paolo Colletti, Messina; Gregorio Bontempo, Barcellona; Francesco Pulvirenti, Catania; Roberto Gariboldi, Milan, all of Italy

[73] Assignees: Co.Ri.M.Me.-Consorzio per la Ricerca sulla Microeletrronica nel Mezzogiorno, Catania; SGS-Thomson Microelectronics S.r.l., Agrate Brianza, both of Italy

[21] Appl. No.: 560,001

[22] Filed: Nov. 17, 1995

[30] Foreign Application Priority Data

Nov. 17, 1994 [EP] European Pat. Off. ..... 94830535.4

[51] Int. Cl.[6] ..... G05F 1/10

[52] U.S. Cl. ..... 327/541; 327/108; 327/309; 327/546

[58] Field of Search ..... 327/309, 108, 327/541, 546

[56] References Cited

U.S. PATENT DOCUMENTS

| | | | |
|---|---|---|---|
| 4,021,701 | 5/1977 | Davies | 361/18 |
| 4,646,219 | 2/1987 | Röhl | 363/21 |
| 4,972,136 | 11/1990 | Banura | 323/275 |
| 5,008,586 | 4/1991 | Miyazaki et al. | 323/315 |
| 5,504,452 | 4/1996 | Takenaka | 327/546 |
| 5,570,060 | 10/1996 | Edwards | 327/541 |

FOREIGN PATENT DOCUMENTS

| | | | |
|---|---|---|---|
| 43 34 386 | 4/1994 | Germany | H02H 3/08 |
| 2 030 808 | 4/1980 | United Kingdom | H02H 3/38 |
| 2179218 | 2/1987 | United Kingdom | H03K 17/04 |
| 2 267 003 | 11/1993 | United Kingdom | H02H 9/02 |

*Primary Examiner*—Margaret Rose Wambach

*Attorney, Agent, or Firm*—David V. Carlson; Seed and Berry LLP

[57] ABSTRACT

A protection circuit for at least one power transistor which has at least one control terminal and two main conduction terminals defining a main conduction path includes a first detection means designed to generate a first electrical signal approximately proportional to current flowing in the main conduction path. Second detection means are designed to generate a second electrical signal approximately proportional to voltage across the main conduction path. Multiplying means receive at input the first and second signals and are designed to generate an electrical product signal substantially corresponding to the product of at least the latter. A generator generates an electrical reference signal, and operational amplifier means receive at input the product signal and the reference signal and are designed to generate an electrical difference signal substantially corresponding to their difference. Control means are designed to drive the control terminal on the basis of the difference signal so that the product signal is not greater than the reference signal.

31 Claims, 6 Drawing Sheets

PROTECTION CIRCUIT AND METHOD FOR POWER TRANSISTORS, VOLTAGE REGULATOR USING THE SAME

TECHNICAL FIELD

The present invention relates to a method and a protection circuit for power transistors and to a voltage regulator using them.

BACKGROUND OF THE INVENTION

In the electronics field there often arises a need for controlling voltages and currents in certain nodes and/or branches of a circuit, such as an integrated circuit, so that these quantities do not exceed maximum values established for design requirements, operating specifications, technological limitations (such as safe operating area, and primary and secondary breakdown), and bonding.

Equally important is control of the power dissipated along certain branches of the circuit which, whether for design specification or limitation of maximum power that can be dispelled by the package containing it, must be limited to a maximum value.

Fairly simple and accurate circuits for protecting MOS and BJT transistors against exceeding a simple current or voltage limit are well known.

SUMMARY OF THE INVENTION

The purpose of the present invention is to supply a method and a circuit sufficiently simple and accurate to protect at least one transistor against exceeding a more complex limit implying processing of multiple electrical quantities associated with the transistor.

In the following description reference is made to the protection of an MOS transistor against exceeding the maximum power that can be dispelled by the package containing them, but the teaching of the present invention applies also to other types of protection, such as against primary and/or secondary breakdown for bipolar junction transistors.

In a method for protecting at least one power transistor having at least one control terminal and two main conduction terminals defining a main conduction path, a first electrical signal is generated approximately proportional to current flowing in the main conduction path. A second electrical signal is generated approximately proportional to voltage across the main conduction path. At least the first and second signals are multiplied, defining an electrical product signal. The product signal is compared with an electrical reference signal, defining an electrical difference signal, and the control terminal is driven by the difference signal in such a manner that the product signal is equal to the reference signal.

A protection circuit for at least one power transistor which has at least one control terminal and two main conduction terminals defining a main conduction path includes a first detection means designed to generate a first electrical signal approximately proportional to current flowing in the main conduction path. Second detection means are designed to generate a second electrical signal approximately proportional to voltage across the main conduction path. Multiplying means receive at input the first and second signals and are designed to generate an electrical product signal substantially corresponding to the product of at least the latter. A generator generates an electrical reference signal, and operational amplifier means receive at input the product signal and the reference signal and are designed to generate an electrical difference signal substantially corresponding to their difference. Control means are designed to drive the control terminal on the basis of the difference signal so that the product signal is equal to the reference signal.

In accordance with another aspect, the present invention also concerns voltage and current regulators, preferably integrated with the protection circuit, in which said circuit finds advantageous application.

Since in many practical cases the complex limit corresponds to the product of at least two quantities, typically a current and a voltage, the circuit in accordance with the present invention generates electrical signals approximately proportional to these quantities, multiplies them, compares the product with a reference signal corresponding to the limit set for the transistor and acts on the transistor in such a manner that the limit is not exceeded.

Advantageously the multiplication of currents can be provided simply by means of connection in series of bipolar transistor junctions at which the currents are supplied to the respective emitters. In this case it is further advantageous to generate the reference signal by means of connection in series of bipolar transistor junctions in such a manner as to have analogous behavior of the multiplier and generator.

BRIEF DESCRIPTION OF THE DRAWINGS

The invention is clarified by the following description considered together with the annexed drawings wherein.

DETAILED DESCRIPTION OF THE INVENTION

Hereinafter when power transistor is discussed it is intended only to indicate the transistor to be protected and which in general is the power type without being absolutely limited to actual power transistors such as DMOS devices. However, power transistor as discussed herein may also refer to power semiconductor devices, such as power MOS transistors, power bipolar transistors, and insulated-gate bipolar transistors ("IGBT").

Figure 2:
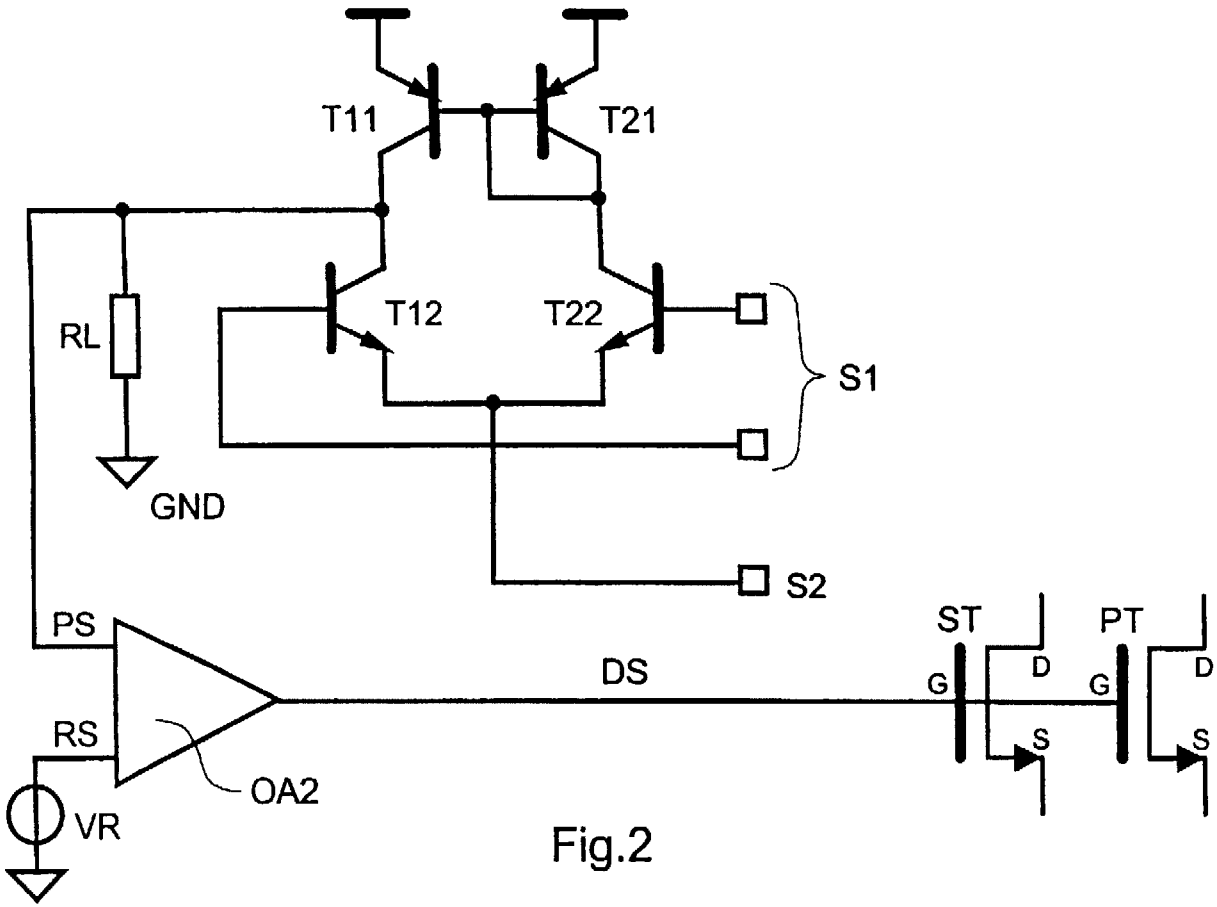
FIG. 2 shows a partial electrical diagram of a first embodiment of the circuit in accordance with the present invention.
Figure 4:
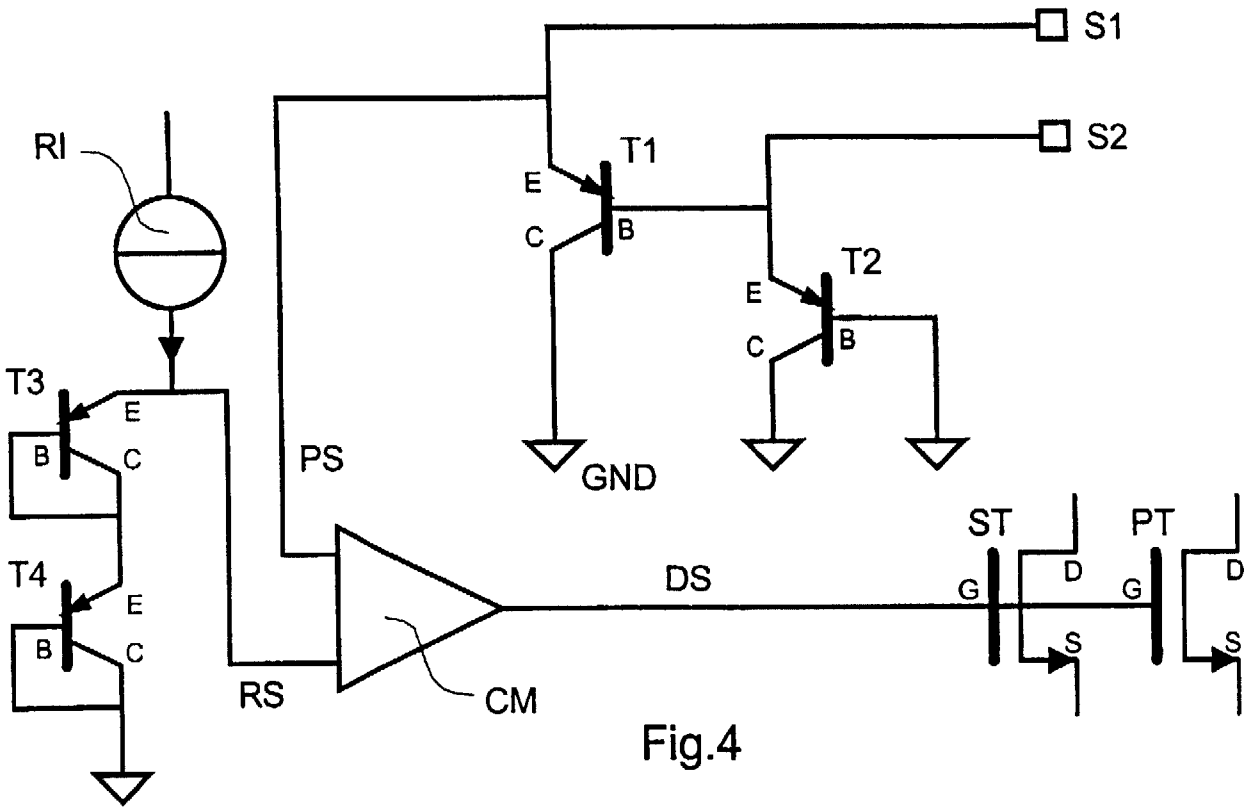
FIG. 4 shows the partial electrical diagram of a second embodiment of the circuit in accordance with the present invention.

With reference to FIG. 2 or 4 the method in accordance with the present invention for protecting at least one power transistor PT, shown in the examples as MOS type power transistors, having at least one control terminal G (the MOS gate) and two main conduction terminals D and S (respectively the drain and source of the MOS) which identify a main conduction path D-S includes the phases:

a) generation of a first electrical signal S1 approximately proportional to the current flowing in the path D-S, b) generation of a second electrical signal S2 approximately proportional to the voltage across the path D-S (in the example the voltage VDS of the MOS), c) multiplication of at least the signals S1 and S2 to obtain an electrical product signal PS, d) comparison of the signal PS with an electrical reference signal RS finding a difference electrical signal, and e) driving of the control terminal G of the transistor PT by means of the signal DS in such a manner that the signal PS is equal to the signal RS.

It will be appreciated that, by means of the signal DS, it would have been possible to drive multiple transistors of different kinds, for example, by decoupling the control terminals by means of appropriate circuitry. In this case the term "main conduction path" is understood in a broader sense and such as to give meaning to the protection concept widened to multiple transistors. As an example, the term main conduction path also includes a conduction path between collector and emitter conduction terminals of bipolar transistors and insulated-gate bipolar transistors. In an alternative embodiment, the signal PS is smaller than the signal RS, as explained later herein.

With reference only to FIG. 4, in a method allowing very simple implementation the signals S1 and S2 are current signals. The signal PS is a voltage signal obtained by means of connection in series of at least two junctions E-B (emitter-base) of a first T1 and a second T2 bipolar junction transistors to which are supplied respectively the signals S1 and S2 through two of their corresponding main conduction terminals E (emitters).

Furthermore in the above mentioned case it is advantageous that the signal RS be a voltage signal obtained by means of connection in series of at least two junctions E-B of two bipolar junction transistors T3 and T4 in such a manner as to have an analogous behavior of the multiplier and the generator in case the four transistors T1, T2, T3, T4 are integrated together.

As mentioned above, the present method lends itself to application also to other protection types, such as, for example, that against the secondary breakdown for the bipolar junction transistors. Indeed, the complex limit corresponds, in accordance with a certain physical model, to the product of the collector current Ic or emitter Ie of the transistor and of the square of the voltage between the collector and the emitter Vce.

The method suited to the type of protection calls furthermore for the phase to generate a third electrical signal approximately proportional to the voltage across the main conduction path (in this case the voltage Vce), and requires that there are multiplied the first, second and third signals corresponding respectively in this case to the current Ic, the voltage Vce and the voltage Vce again.

Figure 1:
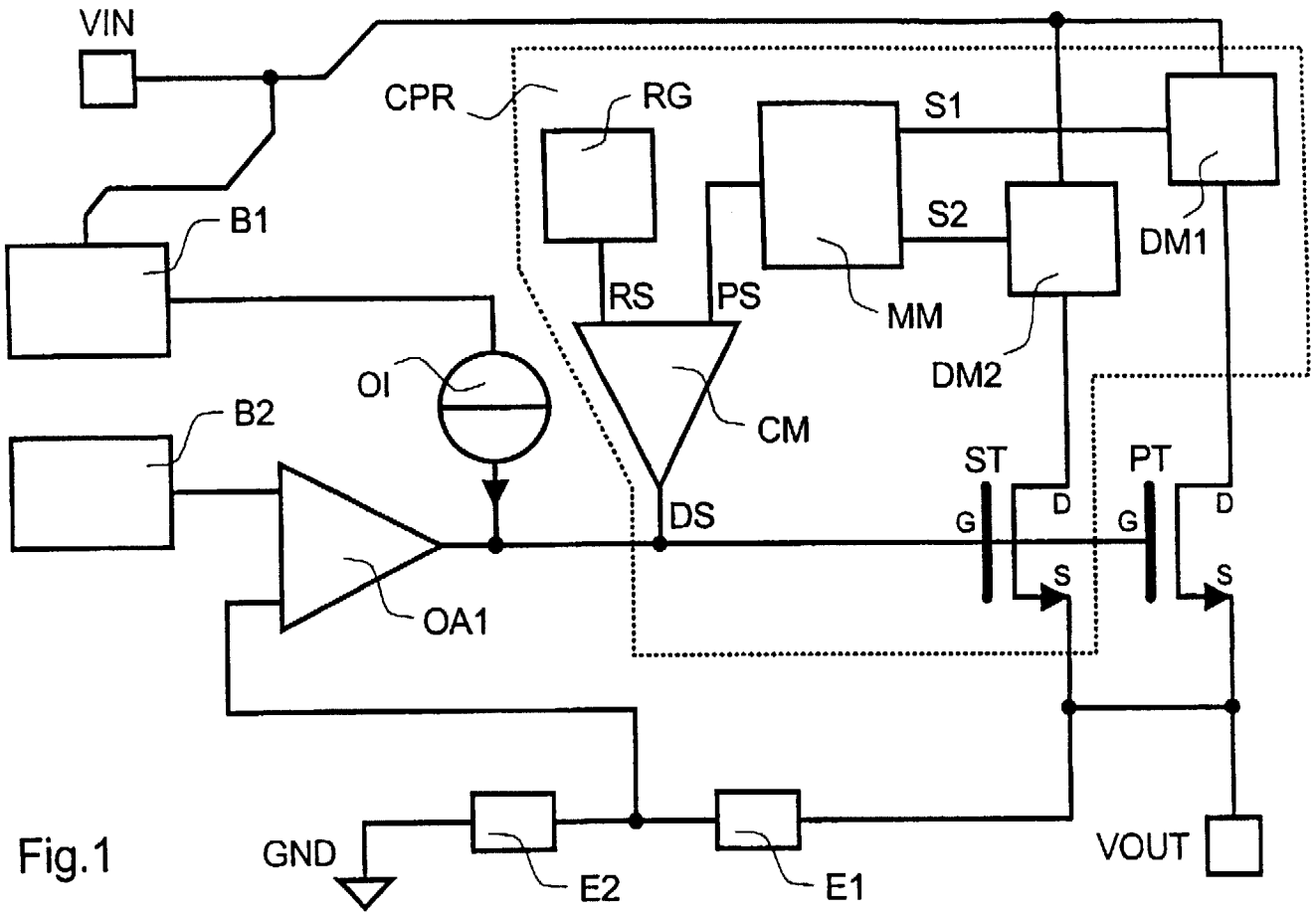
FIG. 1 shows a block diagram of a voltage regulator in accordance with the present invention.

A block diagram of the protection circuit CPR in accordance with the present invention is shown in FIG. 1 inserted in a voltage regulator.

The protection circuit for at least one power transistor PT having at least one control terminal G and two main conduction terminals D, S which identify a main conduction path D-S includes at least:

a) first detection means DM1 designed to generate a first electrical signal S1 approximately proportional to the current flowing in the path D-S of the transistor PT, b) second detection means corresponding in FIG. 1 to the set of a block DM2 and a detection transistor ST designed to generate a second electrical signal S2 approximately proportional to the voltage across the path D-S of the transistor PT, c) multiplier means MM receiving at input the first signal S1 and the second signal S2 and designed to generate an electrical product signal PS substantially corresponding at least to the product thereof, d) a generator RG of an electrical reference signal (RS), e) operational amplifier means receiving at input the signal PS and the signal RS and designed to generate an electrical difference signal DS approximately corresponding to their difference, and f) control means designed to drive the control terminal G of the transistor PT on the basis of the signal DS so that the signal PS is not greater than the signal RS.

In an alternative embodiment, discussed later, the control means is of the type that drives the control terminal G of the transistor PT on the basis of the signal DS so that the signal PS is less than the signal RS.

The operational amplifier means and the control means are represented in FIG. 1 by means of the block CM on the assumption that the output stage of the block is capable of driving the transistor PT. In this case the output stage corresponds substantially to the control means. It is not excluded that in some cases the operational amplifier means and the control means correspond to distinct circuit blocks as is evident for a common designer.

Depending on the type of power transistor (BJT, MOS, IGBT, etc.) the manner of driving the control terminal (the base, the gate, etc.) varies as is well known to those skilled in the art. It can be, for example, a current or a voltage driving. Further, detection transistor ST should be the same type of power semiconductor device as power transistor PT. The examples of FIGS. 1, 2, 4, and show transistor PT and detection transistor ST as MOS transistors. It will be appreciated that when, for example, transistor PT is a BJT, detection transistor ST must likewise be a BJT. Similarly, detection transistor ST must be an IGBT when transistor PT is an IGBT. This ensures that second electrical signal S2 is substantially proportional to the voltage across path D-S of transistor PT.

FIG. 2 shows the electrical diagram limited to the blocks MM, RG, CM of a first embodiment of the circuit in accordance with the present invention.

It includes a transconductance multiplier receiving at first inputs the signal S1, a voltage signal in this case, and at a second input the signal S2, in this case a current signal. The transconductance multiplier includes two transistors T12 and T22 of the bipolar junction type connected in differential configuration. The first inputs correspond to the bases of these transistors while the second input is connected together with their emitters in such a manner as to determine their polarization current. Their collectors are connected to an active load including two transistors T11 and T21 of the bipolar junction type connected as a current mirror. The output of the multiplier (of current) is connected to the collector of the transistor T12 and is supplied to a first terminal of a load resistor RL having its other terminal connected to ground. The resistor has the purpose of converting the output signal of a current signal to a voltage signal corresponding in this case to the signal PS.

In one embodiment, the control means is comprised of an operational amplifier functioning as a differential amplifier OA2 generating the signal DS equal to the difference between the signals supplied to its inputs. This receives at its inverting input the signal PS and at its non-inverting input the signal RS which is in this case a voltage signal generated by a reference voltage generator VR, e.g., a 'bandgap'.

In one embodiment, the comparator CM is thus a standard operational amplifier of the type designed to compare two inputs to each other and output a signal proportional to the difference between these two signals. PS is thus driven to equal RS for this type of operational amplifier.

In an alternative embodiment, an operational amplifier is used of the type which outputs a signal based on the ratios of the two input signals. For this alternative embodiment, the signal DS drives PS to always be less than RS by some selected ratio, as determined by the characteristics of the selected operational amplifier. In this alternative embodiment, the value of PS is assured of not being greater than the value of RS and, by selection of the comparator CM, may be kept always lower. Thus, a margin of safety is automatically built into the circuit.

Figure 3:
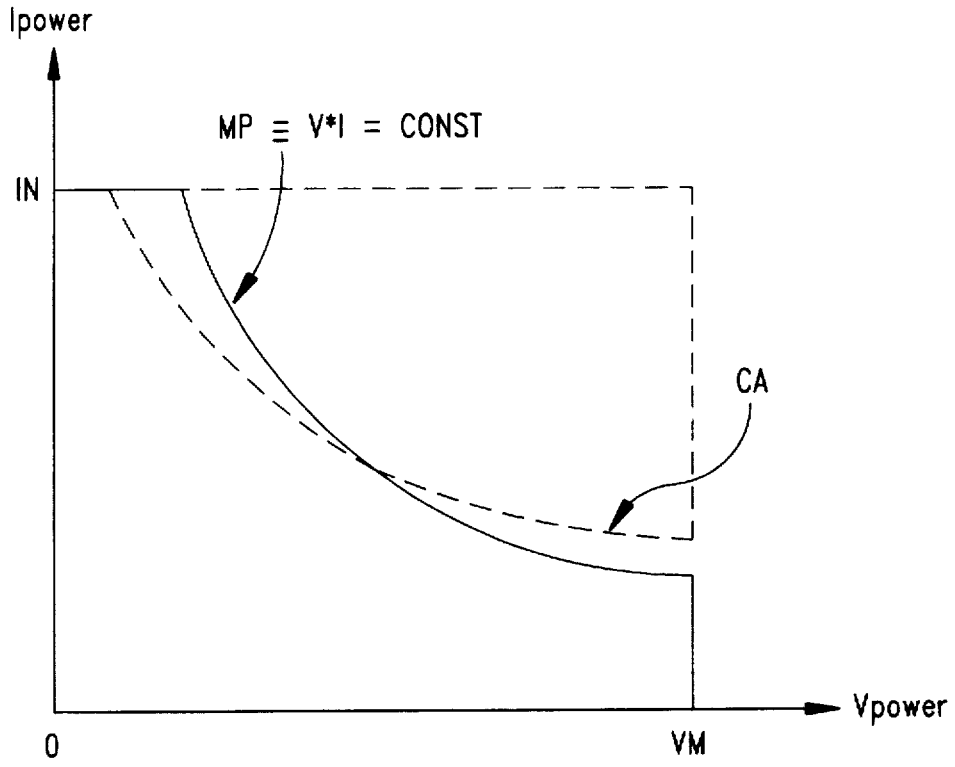
FIG. 3 shows in a voltage-current graph the behavior of the circuit of FIG. 2 compared with the expected ideal behavior.

FIG. 3 shows in a voltage-current graph the ideal behavior expected of the assembly of the means DM1, DM2 and MM by means of the curve MP. The curve MP is a hyperbolic arc corresponding to the dissipation limit of transistor PT limited in current and voltage respectively to the values IM and VM corresponding to the current and voltage limits of the transistor.

Normally the detector means DM1 and DM2 have a fairly linear behavior which is thus close to ideal. The transconductance multiplier provides a multiplication only in a first approximation while in reality it provides a function of the hyperbolic type. This behavior is shown in FIG. 3 by means of the curve CA. As may be noted, by using as dissipation limit the curve CA in certain operating conditions, the capacities of the transistor PT are not completely utilized because the curves CA is below the curve MP, while in other conditions the transistor can be taken to work outside the dissipation limits because the curve CA is above the curve MP.

A first way to solve this additional problem is to choose a curve CA such as to be always below the curve MP. This approach therefore accepts wasting a part of the dissipative capacity of the transistor.

A second way consists of predistorting the signals S1 and/or S2 with a function corresponding to the inverse of the hyperbolic tangent. Naturally, predistortion increases the complexity of the circuit.

A third way consists of designing a multiplier having a transfer function more like a hyperbola and, if possible, having a circuitry not too complex. This way leads to the embodiment of the present invention having the partial electrical diagram shown in FIG. 4.

In this third case, the signals S1 and S2 are current signals and the signal PS is a voltage signal, the means MM include at least two bipolar junction transistors T1, T2 having two corresponding junctions E-B connected in series, the signal PS corresponds substantially to the voltage across the two junctions E-B connected in series, and the current signals S1 and S2 are supplied to two emitter terminals E respectively of the two transistors T1, T2.

The signal PS thus obtained corresponds substantially to the natural logarithm of the product of the signals S1 and S2. This fact does not affect the performance of the circuit because the signal PS is later compared with a constant reference signal and hence, to allow for the presence of the logarithm, it is sufficient to choose an appropriate value for the reference signal.

In the circuit of FIG. 4 the signal RS is a voltage signal. The generator RG includes at least two bipolar junction transistors T3, T4 having two corresponding junctions E-B connected in series, and the signal RS corresponds substantially to the voltage across the two junctions E-B connected in series. To the transistors T3, T4 is supplied the same polarization current through the reference current generator RI.

The transistors T3, T4 are connected as a diode and therefore could in principle be replaced by two actual diodes. The advantage of using two transistors is that in an integrated embodiment of the circuit the transistors T3, T4 can be provided symmetrically with the transistors T1, T2 and therefore optimize the behavior of the multiplier on the basis of the dispersion and the variations in the electrical characteristics thereof.

There are various ways of providing the blocks DM1 and DM2, i.e., generating electrical signals approximately proportional to the current in a branch and to he voltage between two nodes of a circuit. Deviation from ideal behavior could consist, e.g., of the presence of a constant addendum, imperfect behavior of linearity, or intrinsic non-linearity of behavior (non-linear function not deviating significantly from the linear function in the circuit operating range).

Preferred embodiments usable with the circuit of FIG. 4 are discussed below with the aid of FIGS. 5 and 6.

Figure 5:
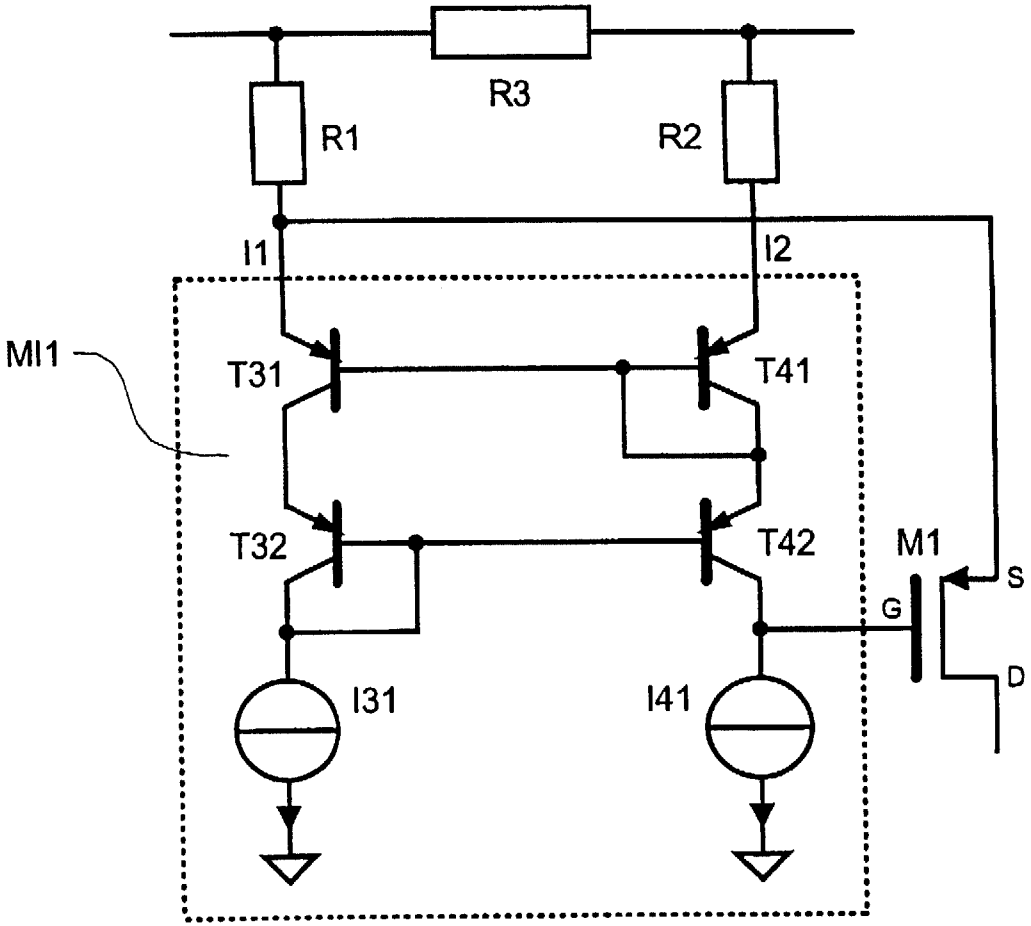
FIG. 5 shows the electrical diagram of current detection means which can be employed in combination with the circuit of FIG. 4.

The circuit of FIG. 5 corresponds with the first detection means DM1 and includes:

a) a low resistance detection resistor R3 connected in series with the main conduction path D-S of the transistor ST, b) two symmetrical resistors R1, R2 having first terminals connected respectively to the terminals of the detection resistor R3, and c) a current mirror circuit MI1 having two inputs I1, I2 respectively connected to second terminals of the symmetrical resistors R1, R2.

The signal S1 corresponds with the current extracted from one of the inputs of the circuit MI1 and specifically the input I1 and due to its unbalance. More precisely, between the input I1 and the output of the circuit of FIG. 4 is interposed the path D-S of an MOS transistor M1 acting as an output buffer.

The resistor R3 must have a sufficiently low resistance so that the voltage drop thereon is small in comparison with the voltage VDS of the transistor PT over the entire circuit operating range. In an integrated embodiment of the present circuit a value of 15 mΩ realized by means of a strip of metal was chosen. Alternatively, any other conductor having a sufficiently low resistance may be chosen. The currents flowing in the circuit MI1 and the current corresponding to the signal S1 must also be small.

If the mirror circuit MI1 is such as to cause flow to the inputs of equal currents the resistances of the resistors R1, R2 must be equal.

The circuit MI1 includes a pair of current generators I31, I41 supplying the collector current respectively to a pair of transistors T32, T42 connected as a current mirror and which in turn supply through the respective emitters the collector current respectively to another pair of transistors T31, T41 which are also connected as a current mirror. The emitters of the transistors T31, T41 are respectively connected to the inputs I1, I2 of the circuit MI1. The gate terminal of the transistor M1 is connected to the collector of the transistor T42.

Figure 6:
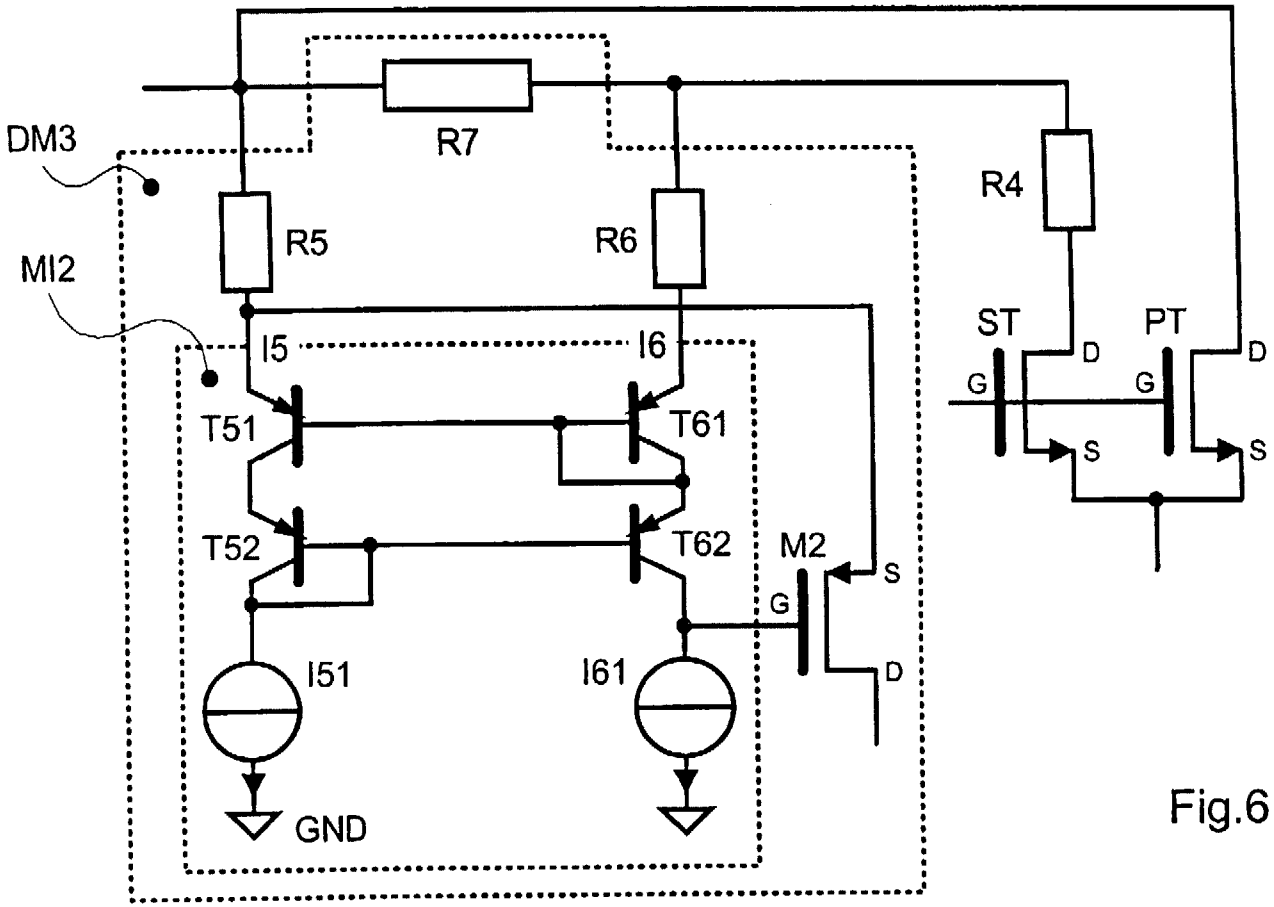
FIG. 6 shows the electrical diagram of voltage detection means which can be employed in combination with the circuit of FIG. 4.

The circuit of FIG. 6 corresponds to the second detection means connected to the transistor PT and includes a detection transistor ST of the same type as the transistor PT but having a smaller channel width-to-length ratio and having its control terminal G connected to the control terminal G of the transistor PT, its source terminal S connected to the corresponding terminal S of the transistor PT, and its drain terminal D to the corresponding terminal D of the transistor PT through at least one limitation resistor R4 (in FIG. 6 the series connection of two resistors R4 and R7) and includes additionally third detection means DM3 designed to generate the signal S2 in such a manner that it is approximately proportional to the current flowing in the limitation resistor R4.

The resistor R4 in combination with the dimensioning of the channel of the transistor ST serves to make the voltage VDS of the transistor ST much smaller than the voltage VDS of the transistor PT. In an integrated embodiment this ratio was chosen 20.000 times smaller than the value of the resistor R4 which is 150 kΩ.

With a net equation including the resistor R4 and the two transistors ST and PT, it is seen immediately that, under the adopted assumptions, there is an approximately proportional link between the voltage VDS of the transistor PT and the current flowing in the resistor R4.

The third detection means DM3 are, in the circuit of FIG. 6, provided by means of the same circuitry solution used for the means DM1 and shown in FIG. 5. They include:

a) a low resistance detection resistor R7 connected in series with the limitation resistor R4, b) two symmetrical resistors R5, R6 having first terminals respectively connected to the terminals of the resistor R4, and c) a current mirror circuit MI2 having two inputs I5, I6 connected respectively to second terminals of the resistors R5, R6.

The signal S2 corresponds to the current extracted from one of the inputs of the circuit MI2, in particular the input I5, and due to its unbalance. More precisely between the input I5 and the output of the circuit of FIG. 5 is interposed the path D-S of an MOS transistor M2 acting as output buffer.

The resistor R7 must have a very low resistance in comparison with the resistance of the resistor R4. In the integrated embodiment of the present circuit mentioned above a value of 1.2 kΩ was chosen.

The circuit MI2 includes a pair of current generators I51, I61 supplying the collector current respectively to a pair of transistors T52, T62 connected as a current mirror and which in turn supply through the respective emitters the collector current respectively to another pair of transistors T51, T61 which are also connected as a current mirror. The emitters of the transistors T51, T61 are respectively connected to the inputs I5, I6 of the circuit MI2. The gate terminal of the transistor M2 is connected to the collector of the transistor T62.

With a net equation including the resistors R5, R6, R7 it is immediately seen that, under the assumptions adopted above and the additional assumptions that R5=R6+R7 and that the mirror circuit MI2 is such as to cause equal currents to flow to the inputs, there is an approximately proportional link between the current in the resistor R4 and the current corresponding to the signal S2. Consequently there is an approximately proportional link between the voltage VDS of the transistor PT and the current corresponding to the signal S2.

As mentioned above, the protection circuit in accordance with the present invention finds advantageous application in voltage regulators.

FIG. 1 shows such a voltage regulator including at least one power transistor PT and one protection circuit CPR for at least the transistor.

The latter exhibits an input VIN referred to the ground GND and an output VOUT. The drain terminal D of the transistor PT is connected to the input VIN through the means DM1 and the source terminal S of the transistor PT is connected directly to the output VOUT.

To the input VIN is connected a first block B1 raising the voltage and supplying it to an output current generator OI having the purpose of driving the gate terminal G of the transistor PT with a voltage sufficiently high to hold it in conduction with changes in the output regulated voltage.

Between the output VOUT and ground GND is connected a voltage divider consisting of the series connection of two resistive elements El and E2. The intermediate tap of the divider is connected to the inverting input of an operational amplifier OA1. The non-inverting input of the amplifier OA1 is connected to the output of a second block B2 generating a reference voltage for regulation, e.g., a bandgap. The output of the amplifier OA1 is connected to the terminal G of the transistor PT in such a manner as to regulate the output voltage in relation to the division ratio of the voltage divider E1, E2.

Of course the protection circuit in accordance with the present invention can find application in many other integrated and unintegrated circuits, and can afford protection to many power semiconductor devices, such as power MOS transistors, power bipolar transistors, and insulated-gate bipolar transistors. While various embodiments have been described in this application for illustrative purposes, the claims are not so limited. Rather, any equivalent method or device operating according to principles of the invention falls within the scope thereof.

We claim:

1. A protection circuit for a power semiconductor device having input and output terminals and a control terminal, the protection circuit comprising:

a detection circuit electrically connectable to a power semiconductor device, said detection circuit outputting a first signal approximately proportional to current between an input terminal of the power semiconductor device and an output terminal of the power semiconductor device, said detection circuit outputting a second signal approximately proportional to voltage across the input and output terminals of the power semiconductor device;

a multiplier circuit inputting the first and second signals and outputting a third signal approximately proportional to a product of the first and second signals;

a reference signal generator outputting a fourth signal; and a control circuit inputting the third and fourth signals and outputting a fifth signal approximately proportional to a difference between the third and fourth signals for driving a control terminal of the power semiconductor device such that the third signal is not greater than the fourth signal.

2. The protection circuit of claim 1 wherein said detection circuit comprises:

a first current detection circuit electrically connectable to an input terminal of the power semiconductor device, said first current detection circuit generating the first signal; and a voltage detection circuit electrically connectable across an input terminal of the power semiconductor device and an output terminal of the power semiconductor device, said voltage detection circuit generating the second signal.

3. The protection circuit of claim 2 wherein said first current detection circuit comprises:

a first current sampling impedance device electrically connectable in series with the input and output terminals of the power semiconductor device; and a first current mirror circuit electrically connected across said first current sampling impedance device, said first current mirror circuit outputting the first signal due to imbalance in said first current mirror circuit.

4. The protection circuit of claim 2 wherein said voltage detection circuit comprises:

a current limiting impedance device having first and second terminals;

a transistor having a control terminal electrically connectable to a control terminal of the power semiconductor device, an input terminal electrically connected to the first terminal of said current limiting impedance device, and an output terminal electrically connectable to an output terminal of the power semiconductor device; and a second current detection circuit electrically connectable to an input terminal of the power semiconductor device and electrically connected to the second terminal of said current limiting impedance device, said second current detection circuit generating the second signal.

5. The protection circuit of claim 4 wherein said second current detection circuit comprises:

a second current sampling impedance device having a first terminal electrically connectable to an input terminal of the power semiconductor device and a second terminal electrically connected to the second terminal of said current limiting impedance device; and a second current mirror circuit electrically connected across said second current sampling impedance device, said second current mirror circuit outputting the second signal due to imbalance in said second current mirror circuit.

6. The protection circuit of claim 1 wherein said multiplier circuit comprises:

a transconductance multiplier coupled to said detection circuit for receiving the first signal as a first input and for receiving the second signal as a second input.

7. The protection circuit of claim 1 wherein said multiplier circuit comprises:

a first transistor having a throughput terminal, a control terminal, and a first junction therebetween, said first transistor inputting the first signal at the throughput terminal; and a second transistor having a throughput terminal, a control terminal, and a second junction therebetween, said second transistor inputting the second signal at the throughput terminal, the first junction and the second junction being electrically connected in series such that the third signal substantially corresponds to a voltage across the first and second junctions.

8. The protection circuit of claim I wherein said reference signal generator comprises:

a first diode junction and a second diode junction electrically connected in series, the fourth signal substantially corresponding to a voltage across the first and second diode junctions.

9. The protection circuit of claim 1 wherein the third signal is smaller than the fourth signal.

10. The protection circuit of claim 1 wherein the third signal is substantially equal to the fourth signal.

11. A voltage regulator comprising:

an input voltage terminal;

an output voltage terminal;

a power semiconductor device having a control terminal, an input terminal, and an output terminal;

a protection circuit electrically connected to the input terminal of said power semiconductor device and to the control terminal of said power semiconductor device, said protection circuit being electrically connected to the input voltage terminal;

a first voltage source having an input coupled to the input voltage terminal and an output;

a current generator having an input coupled to the output of said first voltage source and an output coupled to the control terminal of said power semiconductor device;

a voltage divider coupled between said output voltage terminal and a second voltage source, said voltage divider having first and second elements;

a reference voltage generator having an output; and an operational amplifier having a first input coupled to the output of said reference voltage generator and a second input coupled to said voltage divider, said operational amplifier having an output coupled to the control terminal of said power semiconductor device such that voltage at said output voltage terminal is regulated in relation to a ratio of the first and second voltage divider elements.

12. The voltage regulator of claim 11 wherein said protection circuit comprises:

a detection circuit outputting a first signal approximately proportional to current between the input terminal and the output terminal of said power semiconductor device, said detection circuit outputting a second signal approximately proportional to voltage across the input and output terminals of said power semiconductor device;

a multiplier circuit inputting the first and second signals and outputting a third signal approximately proportional to a product of the first and second signals;

a reference signal generator outputting a fourth signal; and a control circuit inputting the third and fourth signals and outputting a fifth signal approximately proportional to a difference between the third and fourth signals for driving the control terminal of said power semiconductor device such that the third signal is not greater than the fourth signal.

13. The voltage regulator of claim 12 wherein the third signal is smaller than the fourth signal.

14. The voltage regulator of claim 12 wherein the third signal is substantially equal to the fourth signal.

15. Method for protection of at least one power transistor having at least one control terminal and two main conduction terminals defining a main conduction path, the method comprising the following steps:

a) generating a first electrical signal approximately proportional to current flowing in the main conduction path;

b) generating a second electrical signal approximately proportional to voltage across the main conduction path;

c) multiplying at least the first and second signals defining an electrical product signal;

d) comparing the product signal with an electrical reference signal defining an electrical difference signal; and e) driving the control terminal by the difference signal in such a manner that the product signal is not greater than the reference signal.

16. Method in accordance with claim 15 wherein the first and second signals are current signals and the product signal is a voltage signal, and wherein the product signal is obtained by means of series connection of at least two junctions of a first and second bipolar junction transistors to which are supplied respectively the first and second signals through two of their corresponding main conduction terminals.

17. Method in accordance with claim 16 wherein the reference signal is a voltage signal and is obtained by means of series connection of at least two junctions of two bipolar junction transistors.

18. Method in accordance with claim 15, further comprising the step of:

generating a third electrical signal approximately proportional to voltage across the main conduction path and wherein in step d) are multiplied at least the first, second and third signals.

19. Method in accordance with claim 15 wherein the product signal is smaller than the reference signal.

20. Method in accordance with claim 15 wherein the product signal is substantially equal to the reference signal.

21. Protection circuit for at least one power transistor having at least one control terminal and two main conduction terminals defining a main conduction path and comprising:

a) first detection means designed to generate a first electrical signal approximately proportional to current flowing in the main conduction path;

b) second detection means designed to generate a second electrical signal approximately proportional to voltage across the main conduction path;

c) multiplying means receiving at input the first and second signals and designed to generate an electrical product signal substantially corresponding to a product of at least the first and second signals;

d) a generator of an electrical reference signal;

e) operational amplifier means receiving at input the product signal and the reference signal and designed to generate an electrical difference signal substantially corresponding to their difference; and f) control means designed to drive the control terminal on the basis of the difference signal so that the product signal is substantially equal to the reference signal.

22. Circuit in accordance with claim 21 wherein:

the first and second signals are current signals and the product signal is a voltage signal;

said multiplying means comprise at least two first bipolar junction transistors having two corresponding junctions connected in series;

the product signal corresponds substantially to the voltage across the two junctions connected in series; and the first and second signals are supplied to two main conduction terminals respectively of the two first bipolar junction transistors.

23. Circuit in accordance with claim 22 wherein:

the reference signal is a voltage signal;

said generator comprises at least two second bipolar junction transistors having two corresponding junctions connected in series; and the reference signal corresponds substantially to voltage across the two junctions of the second bipolar junction transistors connected in series.

24. Circuit in accordance with claim 21 wherein said first detection means comprise:

a) a detection resistor with low resistance connected in series with the main conduction path;

b) two symmetrical resistors having first terminals respectively connected to terminals of said detection resistor; and c) a current mirror circuit having two inputs respectively connected to second terminals of said symmetrical resistors, the first signal corresponding to a current extracted from one of the inputs of said current mirror circuit and due to its unbalance.

25. Circuit in accordance with claim 21 wherein said second detector means comprise:

a detection transistor of a same type as the power transistor, said detection transistor having a lower channel width-to-length ratio than the power transistor, said detection transistor having a control terminal connected to the control terminal of the power transistor, said detection transistor having a first main conduction terminal connected to the corresponding terminal of the power transistor, said detection transistor and a second main conduction terminal connected to the corresponding terminal of the power transistor through at least one limitation resistor; and third detection means designed to generate the second signal in such a manner that it is approximately proportional to current flowing in said limitation resistor.

26. Circuit in accordance with claim 25 wherein said third detector means comprise:

a) a low resistance detection resistor connected in series with said limitation resistor;

b) two symmetrical resistors having first terminals respectively connected to the terminals of said limitation resistor; and c) a current mirror circuit having two inputs respectively connected to second terminals of said symmetrical resistors, the second signal corresponding to a current extracted from one of the inputs of said current mirror circuit and due to its unbalance.

27. Circuit in accordance with claim 21 wherein the product signal is smaller than the reference signal.

28. Circuit in accordance with claim 21 wherein the product signal is not greater than the reference signal.

29. Voltage regulator comprising:

at least one power transistor having at least one control terminal and two main conduction terminals defining a main conduction path; and a protection circuit for said at least one transistor, said protection circuit including a) first detection means designed to generate a first electrical signal approximately proportional to current flowing in the main conduction path;

b) second detection means designed to generate a second electrical signal approximately proportional to voltage across the main conduction path;

c) multiplying means receiving at input the first and second signals and designed to generate an electrical product signal substantially corresponding to a product of at least the first and second signals;

d) a generator of an electrical reference signal;

e) operational amplifier means receiving at input the product signal and the reference signal and designed to generate an electrical difference signal substantially corresponding to their difference; and f) control means designed to drive the control terminal on the basis of the difference signal so that the product signal is substantially equal to the reference signal.

30. Voltage regulator according to claim 29 wherein the product signal is smaller than the reference signal.

31. Voltage regulator according to claim 29 wherein the product signal is not greater than the reference signal.

* * * * *